US005205198A

United States Patent [19]

Foray et al.

[11] Patent Number: 5,205,198

[45] Date of Patent: Apr. 27, 1993

[54] WORK-HOLDING APPARATUS FOR TABLE POWER TOOLS

[76] Inventors: Brian B. Foray, 8008 S. Austin Ave., Burbank, Ill. 60459; Thomas Ricciardone, 10650 W. 67th St., Countryside, Ill. 60525

[21] Appl. No.: 786,246

[22] Filed: Oct. 31, 1991

[51] Int. Cl.[5] ..... B26D 7/06

[52] U.S. Cl. ..... 83/435.001; 83/437; 83/477.002; 83/454; 144/253 R; 269/55; 269/58; 269/315

[58] Field of Search ..... 83/437, 440, 435.1, 83/477.2, 454; 144/198 A, 253 R, 253 E; 269/55, 58, 309, 315, 249

[56] References Cited

U.S. PATENT DOCUMENTS

| | | | |
|---|---|---|---|
| 1,319,179 | 10/1919 | Royle | 83/437 X |
| 1,651,846 | 12/1927 | Stauder | 144/198 A |
| 2,895,513 | 7/1959 | Cowley | 144/198 A X |
| 4,026,173 | 5/1977 | Livick | 83/421 |
| 4,603,612 | 8/1986 | Atkins | 83/425 |
| 4,732,182 | 3/1988 | Gorsha | 144/198 A |
| 5,018,562 | 5/1991 | Adams | 83/437 X |

*Primary Examiner*—Frank T. Yost
*Assistant Examiner*—Raymond D. Woods
*Attorney, Agent, or Firm*—Lee, Mann, Smith, McWilliams, Sweeney & Ohlson

[57] ABSTRACT

A work holding apparatus for table power tools mounts to a rip fence or other member parallel to the direction feed by a track carrying a clamping frame against which the stock is clamped so that an operator can smoothly and precisely feed the stock into the cutting element of the power tool.

13 Claims, 3 Drawing Sheets

WORK-HOLDING APPARATUS FOR TABLE POWER TOOLS

BACKGROUND OF THE INVENTION

1. Field of the Invention

The invention is a work-holding apparatus adapted to hold stock in a preselected relation to a cutting member in a table power tool, and more particularly, to holding the stock so as to permit movement along a single axis, particularly suited to holding wood on a table saw, shaper or router having a rip fence.

2. Description of the Related Art

A shortcoming in the prior art work holding apparatus remedied by the invention is the prior art's inability to hold stock vertically fixed against both upward and downward movement while permitting a smooth, sliding feed longitudinally. The second shortcoming addressed by the invention is the difficulty the prior art has in maintaining a normal angle to a table when long stock is held vertically for cutting the end of the stock. These problems and the invention's solutions can be seen in reviewing the prior art and the description herein.

Table power tools, and particularly table saws, use the table to provide a smooth surface on which stock can be moved into the blade with improved precision over hand-held saws. A rip fence comprising a rail extending longitudinally parallel to the blade is used to limit horizontal movement of the stock in one direction. Angled cuts are made using a calibrated miter gauge typically slidably carried in a slot recessed in the table. The miter gauge and rip fence are generally mutually exclusive. Router tables and shaper tables use similar attachments.

The aforementioned prior art is generally satisfactory for non-precision work, particularly where a single cut is made through a board lying flat on the table and held manually. Increased utility can be provided through various jigs, or other support or work-holding members. Various methods have been tried in the prior art to limit movement to a desired axial component along a single, substantially longitudinal axis. Owing to factors such as the imprecision in dimensioned lumber, forces induced by the cutting blade, "chatter" induced by blade geometry and other factors, and difficulties in holding stock held vertically, the prior art provides inadequate control.

Prior art attempts to solve certain of these problems include the carriage jig shown representatively in Cowley, U.S. Pat. No. 2,895,513 issued Jul. 21, 1959. This is a right angle fixture which fits in the slot for the miter gauge and includes a single clamp. Cowley neither is capable of holding large, vertically extending stock, nor does it have any inherent control against vertical movement generally, or angular movement around a horizontal axis, except for the weight of the assembly and the downward pressure of the operator who is also pushing the work into the saw blade. Further, the carriage jig shown in Cowley is not adapted to hold particularly long stock, as would be necessary to cut e.g. tongue and groove configurations in the edge of stock owing to its single clamp and need to fit in the miter gauge slot.

U.S. Pat. No. 4,732,182 issued Mar. 22, 1988, to Gorsha, clamps a work piece or stock with a single clamp to cut a dado or slot in the end of a rail. Gorsha is also adapted with an angled member to hold the work piece at a pre-selected angle. Gorsha, however, is slidably carried on the rip fence having a channel fitting over that element. Accordingly, this configuration shares substantially the same limitations as the previously mentioned carriage jig in that it provides no limitation on chatter, rotational movement components, and is only held down by the weight of the apparatus and the downward pressure of the operator who is also sliding the apparatus longitudinally.

Livick, U.S. Pat. No. 4,026,173 issued May 31, 1977, shows a saddle member slidably carried on a fence and guide rail and is substantially entirely addressed to ripping or sawing along the length of the stock. Livick uses two pointed levers to engage the stock for sliding longitudinal movement. Again, there is no disclosure of any mechanism to limit vertical movement or rotational movement or otherwise control e.g. chatter.

Other table saw accessories such as that shown in Atkins, U.S. Pat. No. 4,603,612 issued Aug. 5, 1986, are designed to accomplish other purposes such as limiting kick-back, particularly of small pieces as they may be moved past the saw blade, but in a position where their size makes it dangerous for insertion of the operator's hand to control the stock. The instant invention also provides a remedy to this phenomenon in connection with certain cuts or sizes of stock.

SUMMARY OF THE INVENTION

The invention utilizes the existing rip fence and related fittings for a table saw in the preferred embodiment. Alternative embodiments would include adaptation to use on other table-based power tools such as routers and shapers, adapting the invention for independent mounting without using an existing rip fence or a combination of these.

The invention, in its preferred embodiment, uses a track mounted to the rip fence, or other rigid member selectively rigidly mounted at a certain relationship to the plane of the blade or cutting element. A sliding track is slidingly carried in relationship to the mounted track. On the sliding track is fixedly carried a clamping frame. The clamping frame itself has a plurality of clamp members. The clamp members engage a clamping plate holding the stock between the clamping plate and the clamping frame. A handle on the clamping frame permits the imposition of force moving the stock into engagement with the blade or cutter.

Various objects are satisfied by the invention. One object of the invention is to hold stock in a fixed vertical position limiting both upward and downward movement, while permitting only a smooth, sliding longitudinal feed into a cutter.

Another object is providing a high level of control over the positioning of stock for precise cuts, particularly long cuts on edges of stock as in tongue and groove, or cuts in the end of stock such as rabbets, mortises, and tenons.

Another object of the invention is to provide a greater control over the movement of the stock, in particular limiting rotational movement about any axis by substantially entirely limiting movement to longitudinal movement on a single selected longitudinal axis.

Another object is to provide a clamping arrangement which has sufficient height and inherent lever arm to counteract the lever arm on a long vertically-oriented piece of stock.

Another object is to maintain stock in a position which may be entirely raised above the surface of a table in a power tool thereby cutting a kerf of a selected alignment of a desired parallel or non-parallel relation to the edge of the stock.

Another object of the invention is to provide a way for holding stock which may have an edge of non-linear configuration, such as live edge boards or slices from logs which may not track on the table surface alone.

Another object and advantage of the invention is minimizing kickback by increased control over the stock.

Another object and advantage of the invention is to increase control through multi-point clamping and tracking to minimize the affect of chatter imparted in particular by a saw edge.

DESCRIPTION OF THE PREFERRED EMBODIMENT

Detailed Description of the Drawing

Figure 1:
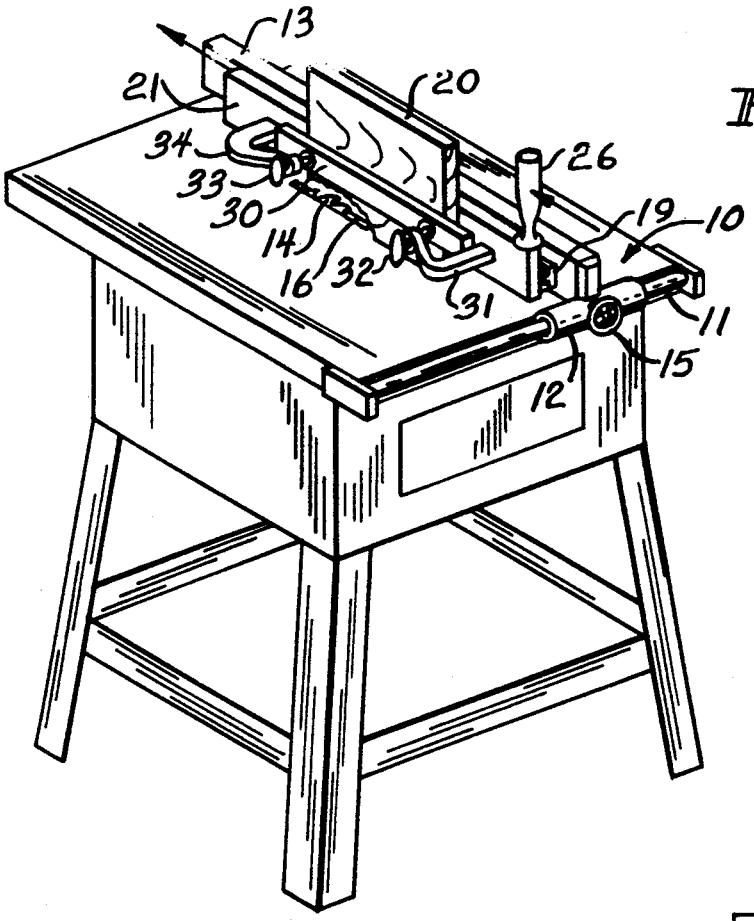
FIG. 1 is a perspective view of the invention.

FIG. 1 is a perspective view of the invention mounted on a typical table power tool 10, in this instance a table saw having a rotating blade 14. The blade 14 extends upwardly through a slot 16 in the table 10. In a typical saw, the blade is adjustable vertically permitting a greater or lesser extension above the surface of the table 10 and is often adjustable for the angle of the plane of the blade 14 relative to the table 10. A typical table saw further has a rail 11 shown to be tubular in the preferred embodiment but which may also be of alternative sectional configuration, sometimes even a simple flange extending from the table casting. As is known in the prior art, a rip fence housing 12 is slidably carried on the rail 11 maintaining a rip fence 13 in fixed angular relationship to the rail 11, preferably normal thereto. In one table saw, a cylindrical casting with a bracket slides on a tube fixed to the front of the table. Because of the fixed relationship between the axis of rotation of the blade 14 and rail 11, the rip fence 13 is carried in a fixed angular relationship to the blade parallel to the plane of rotation thereof. A rip fence adjuster 15 permits selective lateral positioning of the housing and fence assembly on the rail 11. In the described table saw this may be a hand screw or lever which puts tension on the tube, causing friction.

Figure 2:
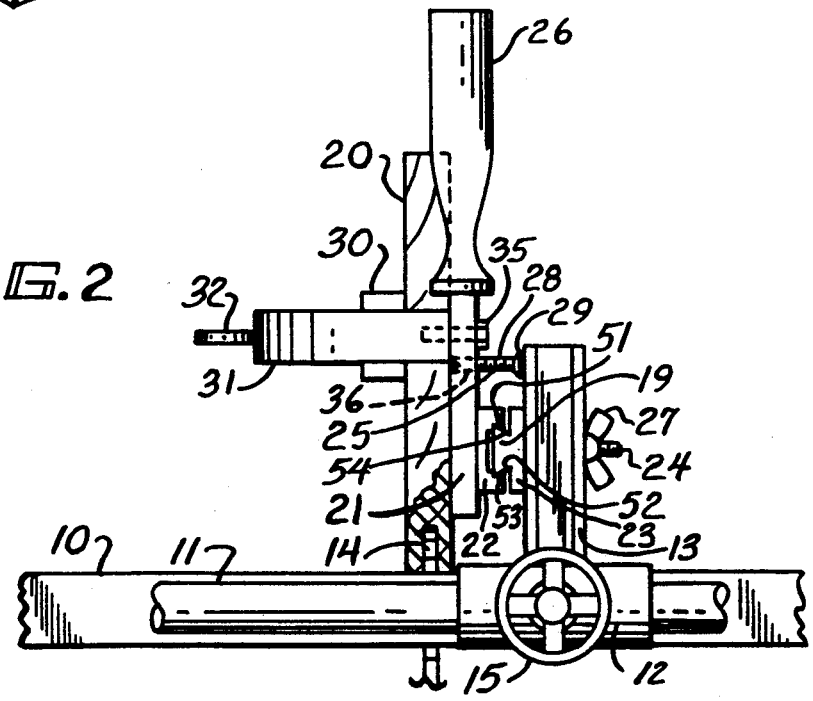
FIG. 2 is a front elevation of the invention.

Apparent in FIG. 1 is clamping frame 21 slidably mounted, through slide 19, on rip fence 13. Sliding the frame feeds the stock into the blade or cutter. Extending sidewardly from plate 21 are first, 31, and second, 34, clamp struts on which are carried the first 32 and second 33 clamping screws or clamping pressure applicators. While the struts 31, 34 and screws 32, 33 are used in the preferred embodiment, functional equivalents including sliding and locking bars and toggle arrangements may be used with equal facility. The screws or clamping pressure applicators 32 and 33 bear on a clamping plate 30. The plate 30 clamps stock 20 in a selected fixed position against the frame 21. A slide assembly 19 slidably mounts the clamping frame 21 to the fence 13. When retrofitted to an existing rip fence, this may be bolted as shown in FIG. 2. Sliding motion is imparted in the preferred embodiment by pushing and pulling a handle 26.

FIG. 2 is a front elevation showing the invention in place on a table power tool, more particularly a table saw in the preferred embodiment. The table 10, rail 11, and saw blade 14 are truncated for clarity in this view. In addition to the description of elements as set forth in connection with FIG. 1, it can be seen in FIG. 2 that the slide assembly 19 comprises a mounted slide track 23 and a sliding track 22. The mounted track 23 is mounted to the rip fence 13 through the use of a mounting stud 24 comprising in the preferred embodiment a threaded fastener which may be fitted in a hole in the rip fence 13 and held in place with a female threaded fastener 27. Other fastener embodiments would provide equivalent mounting of mounted track 23 relative to rip fence 13.

The sliding engagement between tracks 22 and 23 in the preferred embodiment shows corresponding bevels or surfaces providing close engagement therebetween by the interlocking male/female bevels of the tracks, as shown. In the preferred embodiment the mounted track 22 has first 51 and second 52 surfaces which mate with first 53 and second 54 surfaces on the sliding track 23. The interaction of the respective track surfaces permits longitudinal movement to feed the stock into the cutter blade 14 while limiting vertical movement and angular movement about the longitudinal axis. Alternative equivalent slide structures could be used so long as acceptable precision is provided as by various surfaces, bearings and tracks, such as formed sheet metal tracks with ball bearings or self-lubricated plastic sliding bearings, or the like.

In the preferred embodiment, clamping strut 31 is bolted to clamping frame 21 through the use of bolt 35. The specific attachment of clamping elements may be modified without departing from equivalency with the preferred embodiment.

In keeping with the invention, in addition to the sliding engagement of the two tracks 22 and 23, positioning of the clamping frame 21, the elements affixed thereto, and therefore the stock 20 clamped thereto, maintenance of a desired angular relationship between the stock and table is further maintained and adjustment for added precision enhanced by a truing guide 25. In the preferred embodiment, a spacer 28, which may be a threaded shank, adjustably engages a seat, aperture or bore 36 in the frame 21, and opposite said seat, aperture or bore 36, the spacer 28 has a bearing or bearing surface 29. The use of a spacer 28 as a threaded shank or shaft permits small adjustment of the angle between the clamping frame 21 and the rip fence 13. Alternatively, wedges, set screws or cotter pins could accomplish the desired goal of the spacer 28. Placement of the truing guide 25 some distance from the slide 19 also provides an increased effective distance therebetween to counteract unwanted rotational movement substantially about the longitudinal axis enhancing precision of cuts relative to the saw blade 14.

Lateral adjustment by sliding housing 12 along rail 11 and selectively fixing it in place through adjuster 15 moves the entire unit closer or farther from blade 14. In this way, the stock 20 can be precisely placed so as to cut, for example, a groove or dado (as shown), a series of grooves, or a rabbet.

Figure 3:
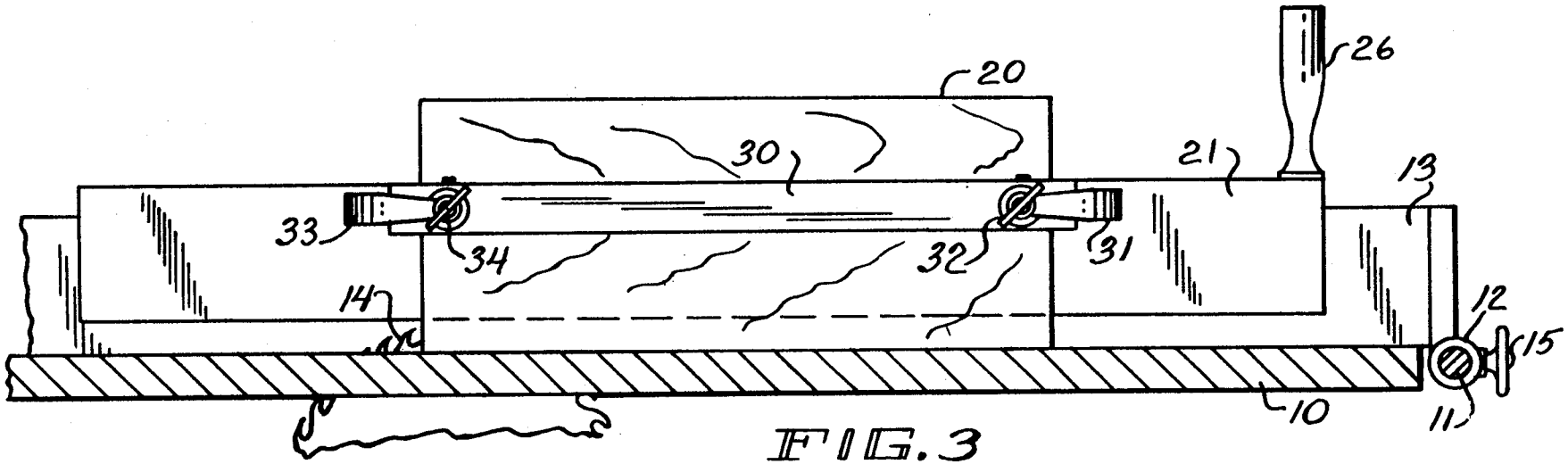
FIG. 3 is a side elevation of the invention.

FIG. 3 is a side elevation showing the invention as mounted to a rip fence 13. The relative length of the clamping plate 30 corresponds substantially to the limits of the length of the clamping plate 21, and is substantially longer than the height of the rip fence 13 and clamping plate 21. This provides for greater control over stock 20 of a substantial length, as when the blade 14 is used to cut a groove in the edge of the stock 20 as indicated in FIG. 2. Further shown in FIG. 3 is the spacing apart of clamping struts 31 and 33. This relationship is also substantially greater than the height of the assembly.

Figure 4:
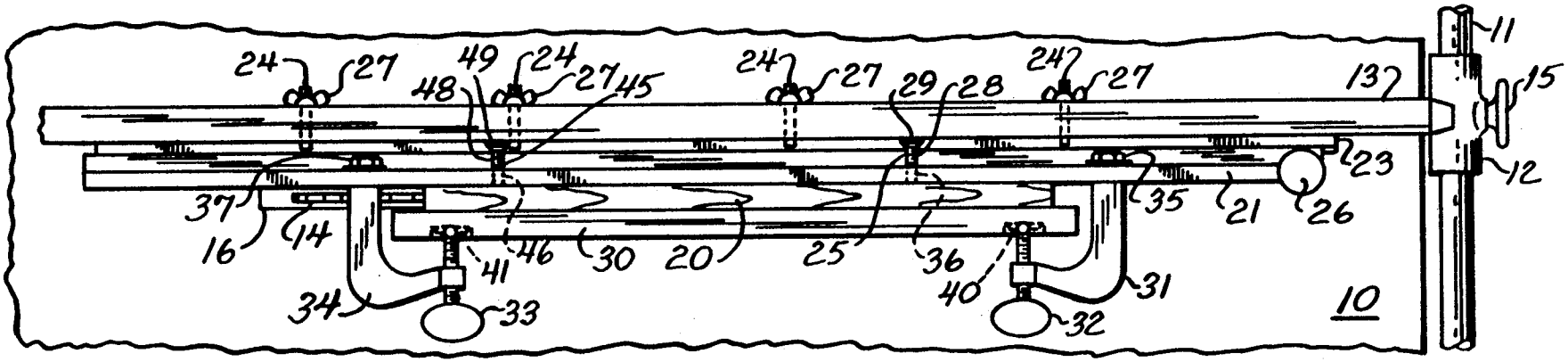
FIG. 4 is a top plan view of the invention.

FIG. 4 is a top plan view of the assembly. Appearing in this view is the use of a plurality of studs 24 and nuts or other fasteners 27 to hold the mounted track 23 in fixed relationship to the fence 13. Also apparent in this view is both the first truing guide 25 with spacer or shank 28 in seat or bore 36 with bearing 29 slidably engaging fence 13, and corresponding second truing guide 45 with second spacer or shank 48, second bearing 49, said shank engaging seat or bore 46.

Apparent in FIG. 4 is first clamping strut 31 threadedly carrying screw 32 which engages first seat 40 in clamping plate 30. Corresponding second strut 34 and second screw 33 engage second seat 41. First 35 and second 37 mounting bolts hold the respective struts 31 and 34 in mounted relationship to the frame 21.

Various features of the invention have been particularly shown and described in connection with the illustrated embodiments of the invention; however, it must be understood that these particular arrangements merely illustrate, and that the invention is to be given its fullest interpretation within the terms of the appended claims.

Figure 5:
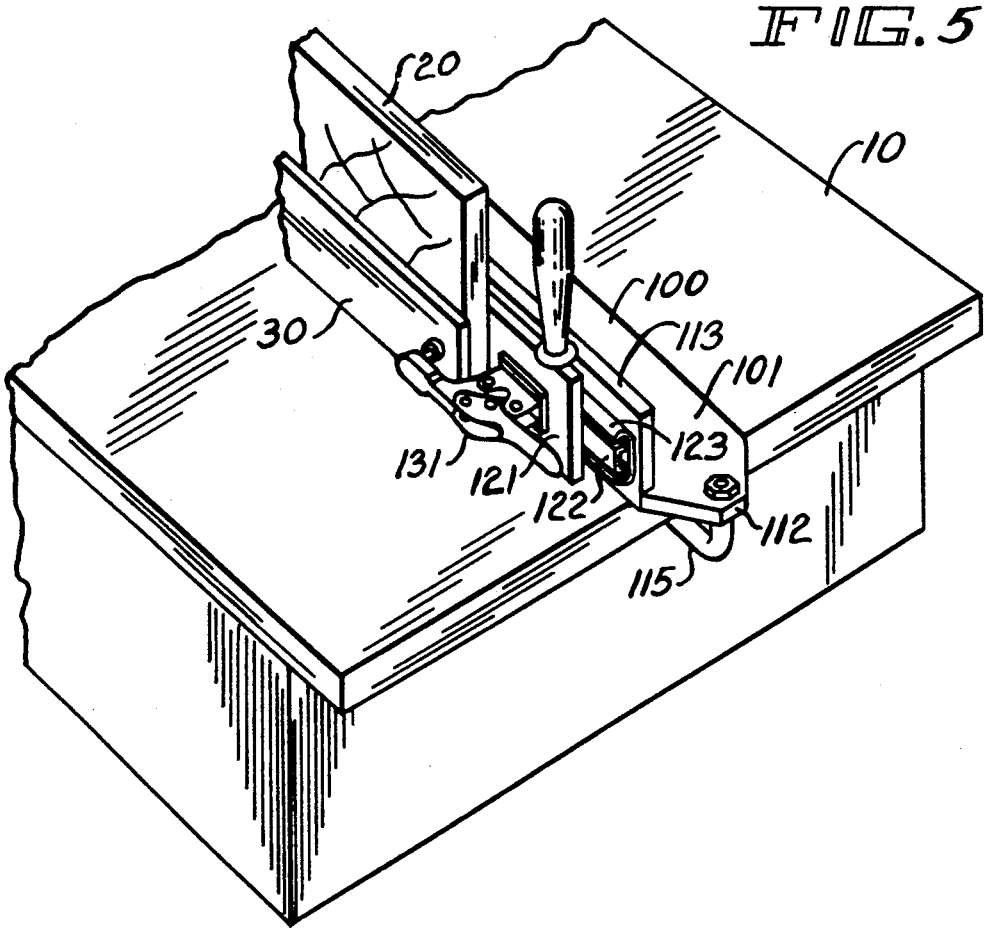
FIG. 5 is an alternative embodiment in which an integral vertical support is substituted for a standard rip fence.

FIG. 5 is a perspective view of an alternative embodiment which illustrates, but is not intended to limit, the departures from the preferred embodiment which may be made accomplishing the goals of the invention and is not submitted by way of limitation of equivalents. FIG. 5 shows a representative table 10 for cutting or shaping stock 20. As alternatives to the embodiments previously described, it can be seen that an angle element 100, which has a horizontal flange 101 and vertical flange 113. On flange 113 is mounted track 123 which slidably carries sliding track 122. This, in turn permits clamping frame 121 to slide along a longitudinal axis and limit vertical and angular movement thereof. An extended ear 112 of flange 101 in this embodiment permits use of a simple hold-down clamp 115 to fix the angle element 100 to the table 10. In this illustration, it will be noted that tracks 123 and 122 can be formed of simple sheet metal for economy and ease of production.

In addition, clamping member 131 which applies pressure on plate 30 can be formed in an alternative configuration. In this embodiment, a spring loaded toggle-type clamp having advantage of quick release and ease and economy of production is utilized. Such toggle clamps are commonly available from woodworkers' supply houses.

Figure 6:
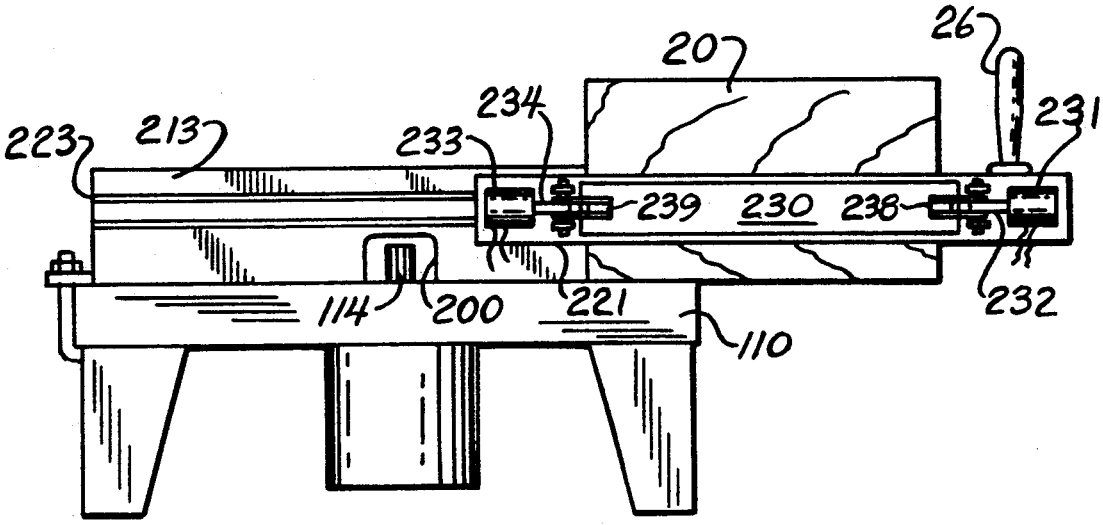
FIG. 6 is an alternative embodiment in which the invention is used on a table power tool other than a table saw.

FIG. 6 is a side elevational view showing an alternative embodiment with the apparatus close to its full extension. This view is also intended to show, without limitation, the breadth of alternative embodiments which can be made without departing from the invention disclosed herein. In this embodiment, a router or shaper table 110 has a cutting element 114 and the apparatus is adapted to feed stock 20 into that cutting element upon application of pressure on handle 26. On clamping frame 221 in this embodiment is mounted an actuator 233 which moves a push rod 234 applying clamping pressure to a mechanism 239 on clamping plate 230. A pair of said clamping elements is completed by second actuator 231, push rod 232, and mechanism 238. Further, it can be seen in this embodiment that the vertical flange 213 on which track 223 is mounted extends substantially the entire length of table 110. Aperture 200 in flange 213 permits clearance and movement to and past the vertical center line of cutting element 114.

What is claimed:

1. A work holding apparatus for positioning and moving stock on a power tool with a table having an upper surface, said power tool including a cutting element, comprising means for mounting said apparatus in a selected position relative to said cutting element: clamping means for releasably holding said stock on said apparatus in a selected plane relative to said cutting element; slide means for slidably moving said clamping means along a longitudinal axis; and means for adjustably positioning said clamping means in a selected angular relationship relative to said mounting means; said mounting means further comprising a plurality of fasteners removably engaging a rip fence having a vertical planar member and being adapted to fit said power tool and said clamping means further comprising a substantially planar clamping frame; a clamp strut with a mounted end and an unmounted end to engage and release clamping pressure; a clamping pressure applicator operatively carried at the unmounted end; a clamping plate being movably carried for clamping said stock between said plate and frame upon engagement of said pressure applicator, and said slide means further comprising a first track with first upper and first lower surfaces mounted to said vertical planar member; a second track with second upper and second lower surfaces mounted to said clamping frame; said first and second upper, and said first and second lower surfaces slidingly interlockingly engaging one another so as to limit movement to substantially longitudinal movement.

2. The apparatus according to claim 1 and said positioning means further comprising a spacer having a first end adjustably seated on the clamping frame and a second end spaced therefrom; said second end having a bearing slidingly engaging said vertical planar member and being vertically spaced from said slide means.

3. The apparatus according to claim 2 wherein said clamping means comprises first and second clamp struts with first and second mounted ends and first and second pressure applicators, bearing on opposite ends of said clamping plate to provide clamping pressure along said plate.

4. The apparatus according to claim 3 and said apparatus extending substantially the entire length of said table with said slide means and clamping means having a length a substantial portion of a length of the apparatus.

5. A work holding apparatus for a table saw with a blade and a rip fence comprising a slide having first and second tracks, the first track being mounted to the rip fence; a frame mounted to the second track, so as to slide relative to the rip fence; a pair of clamps being mounted to the frame; a plate mounted on the clamps to apply pressure toward the frame, thereby holding between the plate and frame stock to be cut by the blade and a bearing being adjustably mounted on the frame for sliding engagement against the fence, said bearing being vertically spaced from the first and second tracks.

6. The work holding apparatus of claim 5 wherein the distance between the clamps is a substantial proportion of a length of the table in a direction of feed.

7. A work holding apparatus for positioning and moving stock on a tool having a table and a cutting element, comprising first means for mounting said apparatus in a predetermined position relative to said cutting element; second means for releasably holding said stock on said apparatus in a selected substantially vertical plane relative to said cutting element; third means for slidably moving said second means along a longitudinal axis; and fourth means for adjustably positioning said second means relative to said mounting means; whereby said stock is held by said second means for sliding by said third means along said longitudinal axis, said fourth means providing angular adjustment substantially around said longitudinal axis, and said first, second, third and fourth means co-act to reduce unwanted relative vertical and angular movement and to substantially limit movement of said second means relative to said means to that along the longitudinal axis.

8. The apparatus of claim 7 wherein said first means further comprise a plurality of fasteners removably engaging a rip fence having a vertical planar member and being adapted to fit said tool.

9. The apparatus according to claim 8 and said second means further comprising: a substantially planar clamping frame; a clamp strut with a mounted end and an unmounted end; a clamping pressure applicator operatively carried at the unmounted end to engage and release clamping pressure; a clamping plate being movably carried for clamping said stock between said plate and frame upon engagement of said pressure applicator.

10. The apparatus according to claim 9 and said third means further comprising a first track with first upper and first lower surfaces mounted to said vertical planar member; a second track with second upper and second lower surfaces mounted to said clamping frame; said first and second upper, and said first and second lower surfaces slidingly interlockingly engaging one another so as to limit movement to substantially longitudinal movement.

11. The apparatus according to claim 10 and said fourth means further comprising a spacer having a first end adjustably seated on the clamping frame and a second end spaced therefrom; said second end having a bearing slidingly engaging said vertical planar member and being vertically spaced from said third means.

12. The apparatus of claim 7 wherein said first means further comprise a bracket having first and second interconnected planar members substantially normal to one another, the first member being a vertical planar member and the second planar member being parallel to and demountably fastened to the table.

13. The apparatus according to claim 12 and said second means further comprising: a substantially planar clamping frame; a clamp strut with a mounted end and an unmounted end; a clamping pressure applicator operatively carried at the unmounted end to engage and release clamping pressure; a clamping plate being movably carried for clamping said stock between said plate and frame upon engagement of said pressure applicator.

* * * * *